US008923690B2

(12) United States Patent
Lollar

(10) Patent No.: US 8,923,690 B2
(45) Date of Patent: Dec. 30, 2014

(54) CLOSE QUARTER ELECTRIC RESISTANCE HEATER AND METHOD OF USE

(75) Inventor: James Patrick Lollar, Baxter, TN (US)

(73) Assignee: Tutco, Inc., Cookeville, TN (US)

( * ) Notice: Subject to any disclaimer, the term of this patent is extended or adjusted under 35 U.S.C. 154(b) by 1089 days.

(21) Appl. No.: 12/851,746

(22) Filed: Aug. 6, 2010

(65) Prior Publication Data

US 2012/0033951 A1 Feb. 9, 2012

(51) Int. Cl.

| | |
|---|---|
| ***F24D 13/00*** | (2006.01) |
| ***H05B 3/46*** | (2006.01) |
| ***H05B 3/16*** | (2006.01) |

(52) U.S. Cl.

CPC ..... *H05B 3/16* (2013.01); *H05B 2203/004* (2013.01); *H05B 3/46* (2013.01)

USPC ..... 392/347

(58) Field of Classification Search

CPC ..... H05B 3/16; H05B 3/46; H05B 2203/004

USPC ..... 219/200, 201, 385, 390, 443.1, 460.1, 219/461.1, 482, 520, 528, 530, 532, 535, 219/536, 538, 541, 542, 543, 546, 548, 549, 219/550, 552, 553; 29/592, 592.1, 610.1, 29/611; 392/301, 347, 407, 432, 435, 465, 392/479, 480

See application file for complete search history.

(56) References Cited

U.S. PATENT DOCUMENTS

| | | | | |
|---|---|---|---|---|
| 3,119,924 | A * | 1/1964 | Kueser | 392/422 |
| 3,214,572 | A * | 10/1965 | Young | 219/550 |
| 5,641,421 | A * | 6/1997 | Manov et al. | 219/553 |
| 2009/0020520 | A1 * | 1/2009 | Forget | 219/461.1 |

* cited by examiner

*Primary Examiner* — Dana Ross
*Assistant Examiner* — Joseph Iskra
(74) *Attorney, Agent, or Firm* — Clark & Brody

(57) ABSTRACT

A close quarter electric resistance heater comprises a ribbon heater element that is woven between ribbon support segments and within a heater shell. The ribbon support segments form an annulus on each end of the heater and are linked to each other using connectors. The connectors space the ribbon support segments apart from each other to facilitate the weaving of the ribbon element along the inside of the heater shell for heating purposes. The connectors also link the ribbon support segments to the shell. The ribbon heater element has faces that are wider than its edges and the ribbon heater element is woven on the support segments such that the edges face the heater shell. This configuration minimizes the migration of the ribbon heater element towards the shell and possible short circuiting of the heater.

10 Claims, 8 Drawing Sheets

CLOSE QUARTER ELECTRIC RESISTANCE HEATER AND METHOD OF USE

FIELD OF THE INVENTION

The present invention is directed to an electric resistance heater with an improved resistance wire configuration to avoid problems with migration of the resistance wire heater elements and shorting during heater operation.

BACKGROUND ART

Resistance wire heaters of various configurations are well known in the prior art. One application of these types of heaters is in chemical analysis equipment, wherein an oven is needed to be able to closely control temperature of an oven space over an extended period of time. For example, the oven may receive test tubes that must be heated at a precise temperature over a set period of time.

One such heater is shown in FIGS. 1A-1C and designated by reference numeral 10. This heater is commonly referred to as a close quarter heater because of heater is typically confined in a location where space is at a premium. Thus, the heating elements of the heater have to be located in close proximity to the heater structure that this creates inherent problems in terms of the heater elements contacting heater structure and causing short circuiting. The heater of FIGS. 1A-C employs a cylindrical support 1 that has a plurality of insulators 3 mounted in spaced relationship along the inside of the support 1. The insulators each have a plurality of bores 5, along the length thereof and are secured to the support 1 using rivets 6. The bores are sized to receive the resistance wire while it is held by the insulators 3. Terminal block 9 is mounted to the support 1 to terminate the resistance wire.

As shown in FIG. 1B, the resistance wire 7 is in the form of a coil with two ends 11 and 13. The ends 11 and 13 are spirally threaded through the bores 5 in the insulators 3 until the resistance wire occupies all of the bores of the insulators 3. The ends 11 and 13 of the wire 7 are terminated using terminal block 9 for connection to a source of power via lead wires 15 and 17.

One problem with these types of close quarter heaters is that the resistance wire can migrate during heater operation. Based on a vertical orientation of the support 1 as shown in FIG. 1, this migration can occur both vertically so that the adjacent wires can touch each other and horizontally so that the wires can touch the support 1. In either event, this touching will result in a short circuiting and heater failure. As a result of migration, the prior art heater is equipped with insulation between the support and the resistance wire to avoid short circuiting.

Another problem with these types of heaters is that they are costly to make. The insulators 3 must be precisely formed and arranged on the support 1 so that the winding of the wire 7 can be performed. In addition and as mentioned above, insulation is required to separate the coiled wires extending between the insulators 3 and the support 1, thus increasing the cost of the heater. Typically, this is a mica sheet interposed between the support and the resistance wires.

In light of the problems with the prior art close quarter heaters, a need exists for an improved heater design that reduces or eliminates the short circuiting problem and provides a heater design that can be made in a more economical fashion.

The present invention responds to this need by providing a close quarter resistance heater that is economical to manufacture and does not have the short circuiting potential found in prior art heater designs.

SUMMARY OF THE INVENTION

It is a first object of the invention to provide an improved electrical resistance close quarter heater.

It is another object of the invention to provide a close quarter electrical heater that employs a ribbon heater element that is specially configured with respect to the heater element support to minimize or avoid the possibility of short circuiting.

A further object of the invention is a method of using the electrical resistance heater to heat a material without concern for short circuiting during the heater operation.

Other objects and advantages will become apparent as a description of the invention proceeds.

In satisfaction of the foregoing objects and advantages, the present invention provides an electric resistance heater that includes a shell having a first open end and a second open end and a heater element assembly.

The heater element assembly comprises at least a first insulating support segment and at least a second insulating support segment, the first and second insulating support segments mounted together and in a spaced apart relationship using a plurality of connectors, the plurality of connectors also mounted to the shell. A resistance ribbon heater element is provided that has opposing edges and opposing faces and is mounted between the first and second insulating support segments in a generally sinusoidal pattern, preferably with a rectangular cross section. The width of the opposing faces is greater than a width of the opposing edges.

Also provided is a termination assembly comprising an insulator mounted to one of the connectors where ends of the ribbon heater element terminate in the shell and a pair of terminals mounted to the insulator and respectively connected to ends of the ribbon heater element. The ribbon heater element is mounted to the shell such that one of the opposing edges of the ribbon heater is facing an inside surface of the housing to minimize movement of the ribbon heater element towards a surface of the shell and short circuiting.

The heater shell can have any number of cross sectional shapes, with a tubular or cylindrical configuration preferred.

The insulating material of the heater can be any known type with a preferred type being mica insulation. The first and second insulating support segments can be one piece in design or formed from a number of segments.

The insulating segments are preferably formed with spaced apart slots to receive the ribbon heater element. While the connectors can have any shape to space apart the insulating, it is preferred that each connector have a y-shape with a first leg and opposing pair of second legs, with each of the first and second legs having flanges for mounting to the insulating support segments. The connectors can also have at least one opening for mounting to the shell.

The invention also entails a method of heating a space using electrical resistance heating, wherein the space is heated using the inventive heater.

BRIEF DESCRIPTION OF THE DRAWINGS

Reference is now made to the drawings of the invention wherein.

DESCRIPTION OF THE PREFERRED EMBODIMENTS

The invention offers significant advantages in the field of close quarter resistance heaters in that the problems associated with high costs and shorting are reduced or eliminated. In contrast to prior art heaters that require some form of insulation adjacent the resistance heating wires to avoid a short circuit possibility, the inventive heater can arrange a specially shaped heater wire in a configuration where it is closely spaced to an heater wall without the need to supply insulation between the ribbon element and the wall.

Figure 1A:
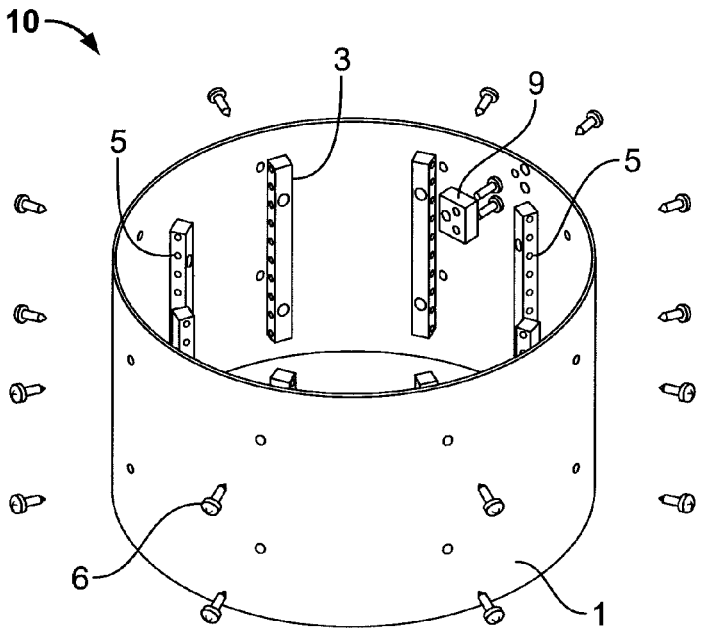
FIG. 1A (Prior Art)
FIG. 1A is a perspective view of a support for a prior art heater.
Figure 1B:
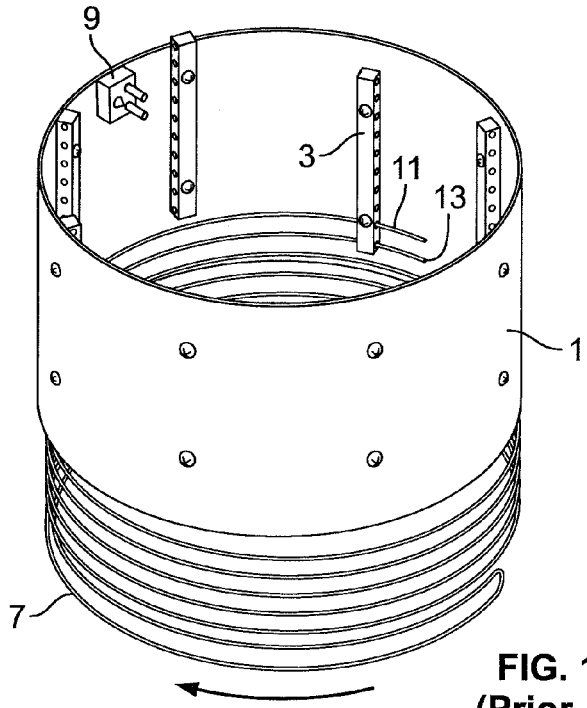
FIG. 1B (Prior Art)
FIG. 1B is a perspective view of the support of FIG. 1A showing winding of resistance wire thereto.
Figure 1C:
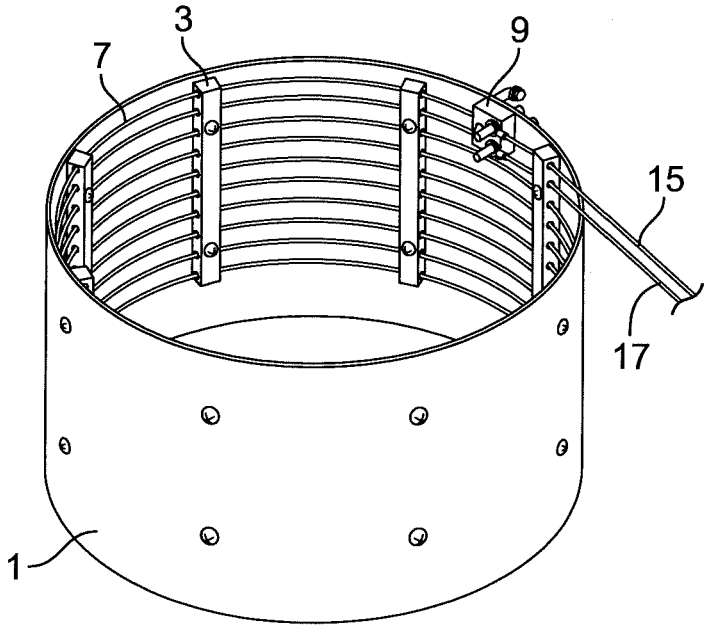
FIG. 1C (Prior Art)
FIG. 1C is a perspective view of the completely wound heater of FIG. 1B.
Figure 2:
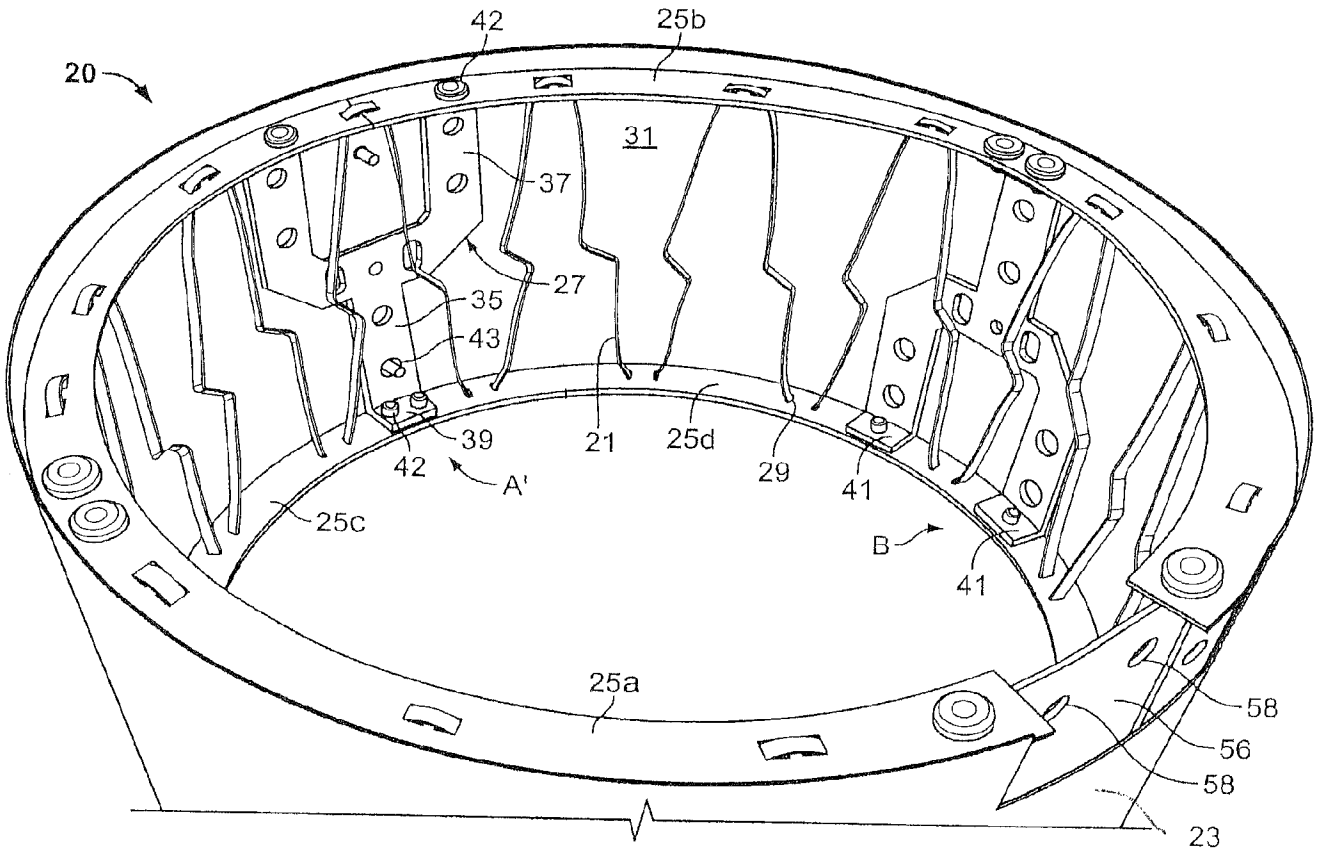
FIG. 2 shows a perspective view of one embodiment of the electric resistance heater of the invention.

One embodiment of the invention is depicted in FIGS. 2-11. In FIG. 2, the heater is designated by the reference numeral 20 and includes a ribbon heater element 21, a cylindrical shell 23, ribbon support segments 25*a*-25*d*, and connectors 27. The connectors 27 are designed to space the ribbon support segments apart so that they can support the ribbon element and indirectly secure the ribbon support segments 25*a-d* to the shell 23.

The ribbon support segments 25*a-d* are made of an insulating material, preferably mica. Each of them has a number of slots 29 arranged along their arcuate length. The slots are sized to receive the ribbon heater element 21 so that the ribbon heater element can extend between spaced apart support segments and along an inner surface 31 of the shell 23. In the illustrated embodiment, there are four (4) support segments, two on one side of the heater, segments 25*a* and 25*b*, and two on the other side of the heater, 25*c* and *d*. Segments 25*a* and 25*b* form a first annulus and segments 25*c* and 25*d* form a second annulus. As shown in FIG. 2, the ribbon passes through the slots 29 in the segments 25*a-d* so as to span the inner surface 31 of the shell 23 and generate heat within the shell 23 for the intended heating application.

Figure 8:
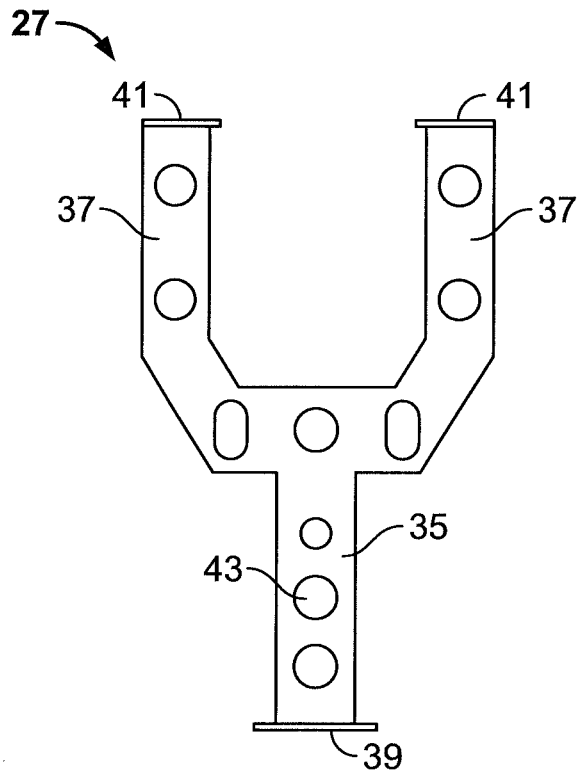
FIG. 8 shows the connector linking adjacent ribbon holders together and to a shell of the heater.
Figure 9:
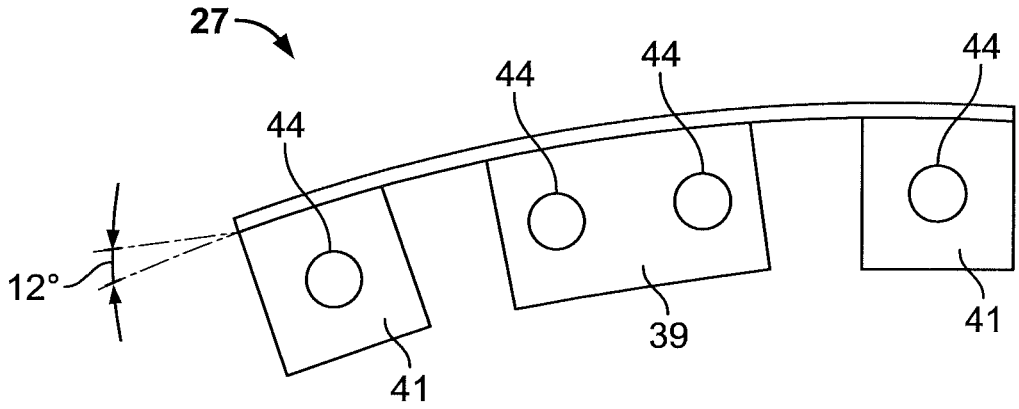
FIG. 9 shows a top view of the connector of FIG. 8.

The ribbon support segments 25*a-d* are spaced apart from each other and connected to the shell using the connectors 27, with one connector shown in detail in FIGS. 8 and 9. The connectors are y-shaped with a first leg 35 joined to a pair of second legs 37. First leg 35 has a flange 39 on its free end with legs 37 each having a flange 41 on their respective free ends. The connector 27 is made with a number of openings 43 in the legs to reduce the amount of material, thus saving weight and costs and provide for attachment to the shell 23 as explained below. As shown in FIG. 9, the connectors have a slight curvature to them so that they follow the contour of the cylindrical shell 23 when in place.

The flanges 39 and 41 are designed to attach to the ribbon support segments for spacing purposes using the openings 44 in the flanges 39 and 41. The connector 27 is positioned in a certain orientation to connect to one or two ribbon support segments with the free ends of the ribbon support segments configured to facilitate the connection between ends of the support segments as well as accommodate the termination of the ribbon element 21.

Figure 3:
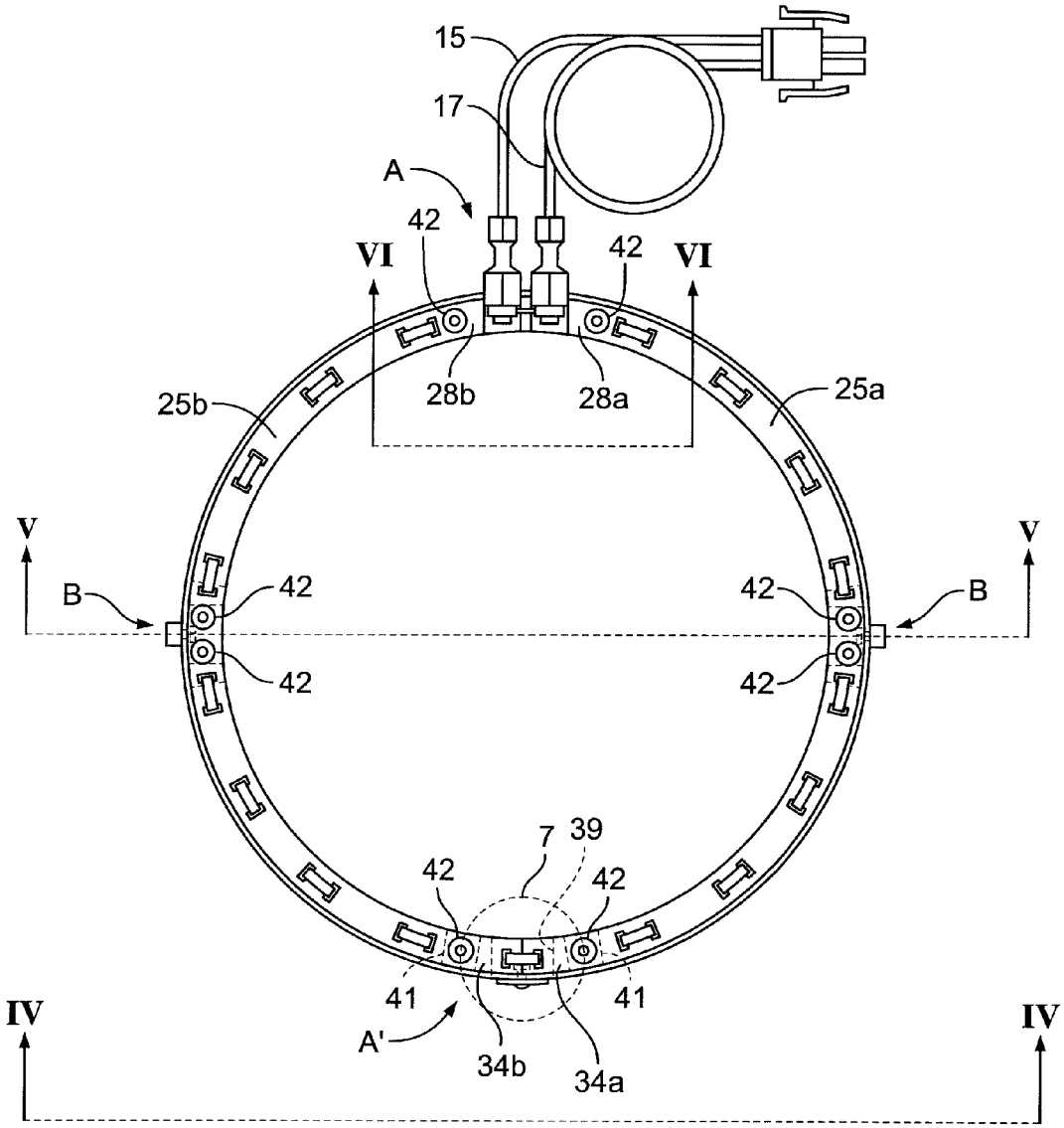
FIG. 3 shows a top view of the heater of FIG. 2.

In FIG. 3, there is a termination connection A, where the ribbon support segments 25*a* and 25*b* are configured, i.e., have a certain arcuate length to accommodate the termination of the ribbon element 21 and allow connection of the ends 28*a* and 28*b* of the segments 25*a* and 25*b* using the flanges 41 of the connector 27. More particularly, the ends 28*a* and 28*b* of segments 25*a* and 25*b* shown in FIG. 3 each have an opening that aligns with the openings 44 of the flanges 41 of the connector 27 for connection purposes. A fastener such as a rivet 42 secures the flanges 41 and ribbon support segments 25*a* and 25*b* together. Ribbon support segments 25*a* and 25*b* are different from segments 25*c* and 25*d*. Segments 25*c* and 25*d* have a length so that their respective ends meet to permit continued weaving of the ribbon element 21. This configuration of the mica ribbon support segments is a significant cost saving advantage since the segments are more easily manufactured in 180 degree segments of a circle.

Figure 4:
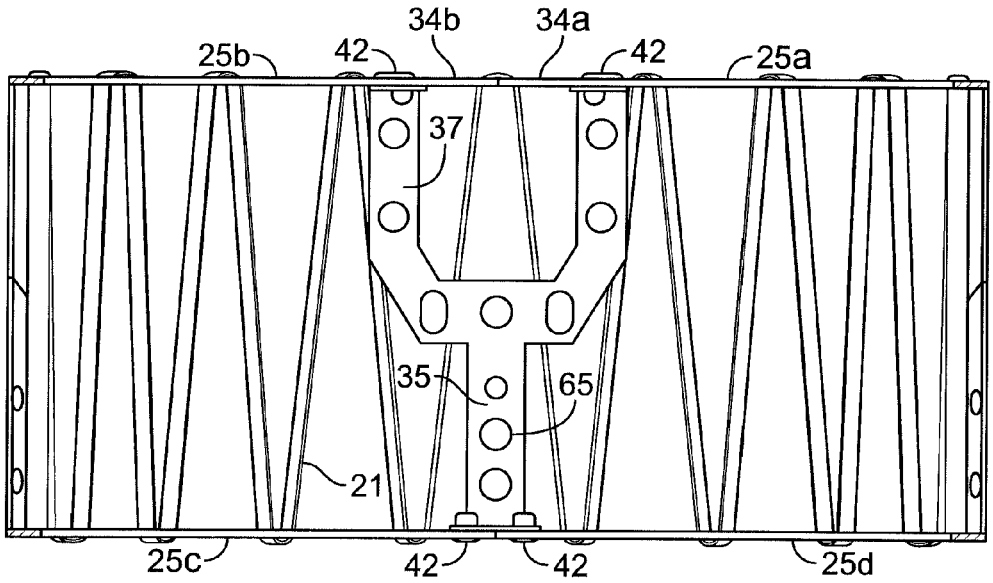
FIG. 4 shows a view along the line IV-IV of FIG. 3.
Figure 5:
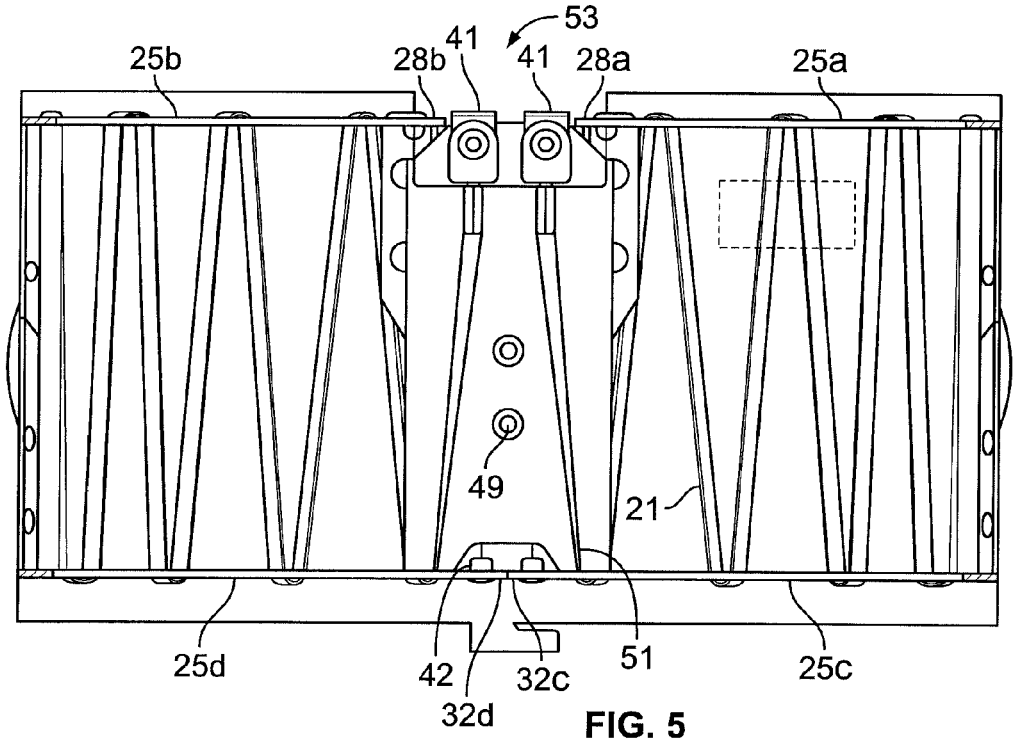
FIG. 5 shows a view along the line V-V of FIG. 3.

FIG. 5 depicts both segments 25*a* and 25*b* and shows how they interface with the opposing segments 25*c* and 25*d*. The same type of connector orientation is also shown in FIG. 4 and discussed below. Segments 25*c* and 25*d* in FIG. 5 use the leg 35 and its single flange 39 of connector 27 (not seen) to link together. The segments 25*c* and 25*d* have openings that are formed closer to the free ends 32*c* and 32*d* of each segment 25*c* and 25*d* than the openings near the free ends 28*a* and 28*b* of segments 25*a* and 25*b* shown in FIG. 3. This enables fasteners 42 to extend through the openings 44 in the flange 39 and openings in the respective ends 32*c* and 32*d* of the segments 25*c* and 25*d*. To reiterate, the spaced apart ends 28*a* and 28*b* of segments 25*a* and 25*b* use the flanges 41 for joining since the termination occurs in the space formed by ends 28*a* and 28*b* and the segments 25*c* and 25*d* use the flange 39 of connector 27 to keep the ends 32*c* and 32*d* together.

Referring back to FIGS. 3 and 4, a connection identified as A' that is diametrically opposed to connection A is shown between segments 25*b* and 25*c*. Connection A differs from connection A' since the length of segments 25*a* and 25*b* is made shorter than the length of segments 25*c* and 25*d* to accommodate the termination of the ribbon element 21, which is discussed below in more detail. However, the orientation of the connector 27 is the same between connections A and A' so that in connection A' shown in FIG. 3, the flanges 41 of the connector are used with fasteners 42 to link the ends 34*a* and 34*b* of segments 25*a* and 25*b* together. In FIG. 4, the lower segments 25*c* and 25*d*, which are not shown in FIG. 3, are joined using the single flange 39 of leg 35 of connector 27 just as described for FIG. 5.

Referring to FIGS. 4 and 5, instead of having openings near the free ends 32*c* and 32*d* of segments 25*c* and 25*d* to accommodate attachment of the segments to the flange 39 (see FIG. 5), the support segments 25*a* and 25*b* have slots 29 nearer the free ends 34*a* and 34*b* to accommodate the weaving of the ribbon element 21, see FIG. 4 in particular.

In order to maintain the spacing between support segments along their arcuate length, other connectors 27, i.e., connections B, are used for spacing purposes. Since there are no free edges at connections B to link together, the connectors 27 merely space the segments apart. For connections B, the orientation of connector 27 shown in FIGS. 4 and 5 is reversed 180 degrees. Thus, the flange 39 of the connector attaches to the segments 25*a* and 25*b* and the flanges 41 of the connector attach to segments 25*c* and 25*d*.

One advantage of the connector 27 and its Y-shape is its ability to maintain the configuration of the ribbon element as it weaves through the slots 29 in the segments, i.e., the ribbon element maintains is sinusoidal pattern across the junctions between the different segments. This is achieved by the use of the alternate orientations of the connector 27 when connecting the adjacent ribbon segments, e.g., 25*a* to 25*b* and 25*c* to 25*d*. For example, at connection A' as illustrated in FIG. 3, the ends 34*a* and 34*b* of the segments 25*a* and 25*b* are configured so that the slots 29 are positioned between the openings in the segments that receive fasteners 42 for attachment to the flanges 41 and the free end. In connection B as illustrated in FIG. 3, the openings in the segments for fastening to the two openings in the flange 39 are positioned between adjacent slots 29.

Another advantage of the ribbon support segments is that they are free floating with respect to the heater shell 23. Since they are indirectly connected to the shell 23 using the connectors 27, they can move independently of the shell and accommodate movement that may occur in the ribbon element 21 during the heater operation.

Figure 10:
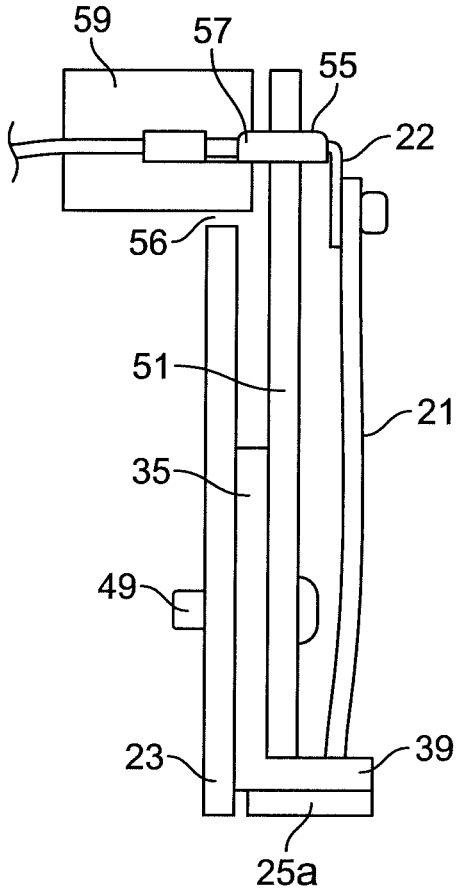
FIG. 10 is a schematic drawing showing the termination of the resistance wires of the heater of FIG. 2.

Referring to FIGS. 2, 3, 5, 6, and 10, connection A also includes insulator 51, preferably mica board, between the portion of the ribbon element 21 as it extends from the slots 29 at junction of segments 25*c* and 25*d* in FIG. 5 to the termination point 53, see particularly FIG. 10. The termination point 53 is typical of terminations for resistance wire heaters, wherein a pair of terminals 55 attach to the ends of the ribbon element and connect the ribbon element 21 to power via lead wires. With reference to FIG. 5, it can be seen that the ribbon support segments 25*a* and 25*b* are shorter in arcuate length so as to form an opening for the termination of the ribbon element ends.

FIGS. 2 and 10 more clearly show the mica board 51, the shorter ribbon support segments 25*a* and 25*b* as well as the cutout 56 in the shell 23 to facilitate termination. The mica board 51 is shown with two holes 58 to receive the ends of the terminals 55 (one shown in FIG. 10), which are insulated by terminal block 59, with the ribbon element ends 22 fastened thereto as part of the termination.

Figure 6:
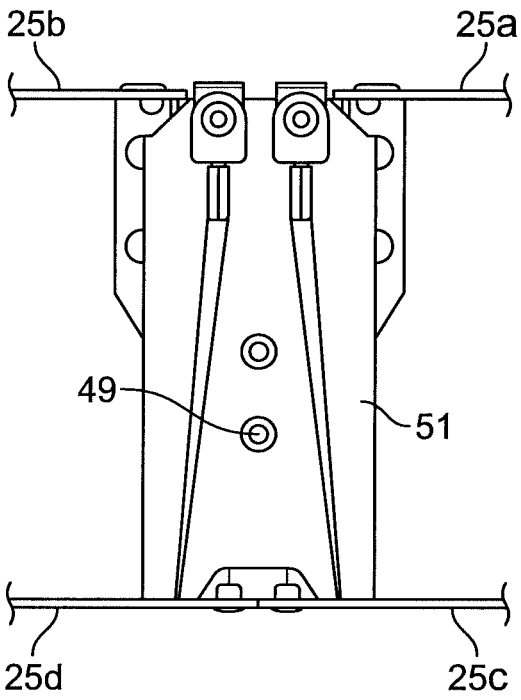
FIG. 6 shows a view along the line VI-VI of FIG. 3.

The connectors 27 not only space the segments apart but also act to connect the free ends of the segments together. The connectors 27 are also instrumental in linking the ribbon support segments 25*a-d* to the shell 23. As shown in FIG. 6, one of the openings 43 in the connector 27 has a rivet 49, which extends through the connector 27, mica board 51 and is connected to the shell 23. With the connector 27 linking the ribbon support segments together using the flanges 39 and 41 and rivets 49 or other fasteners attaching the connectors 27 to the shell 23, a heater assembly made up of the shell, segments, ribbon element, connectors 27, fasteners, and insulation at the termination is created that can provide heat to the volume located within the shell 23. A similar connection between the connectors 27 and shell 23 are made for connections B and A'.

Figure 7:
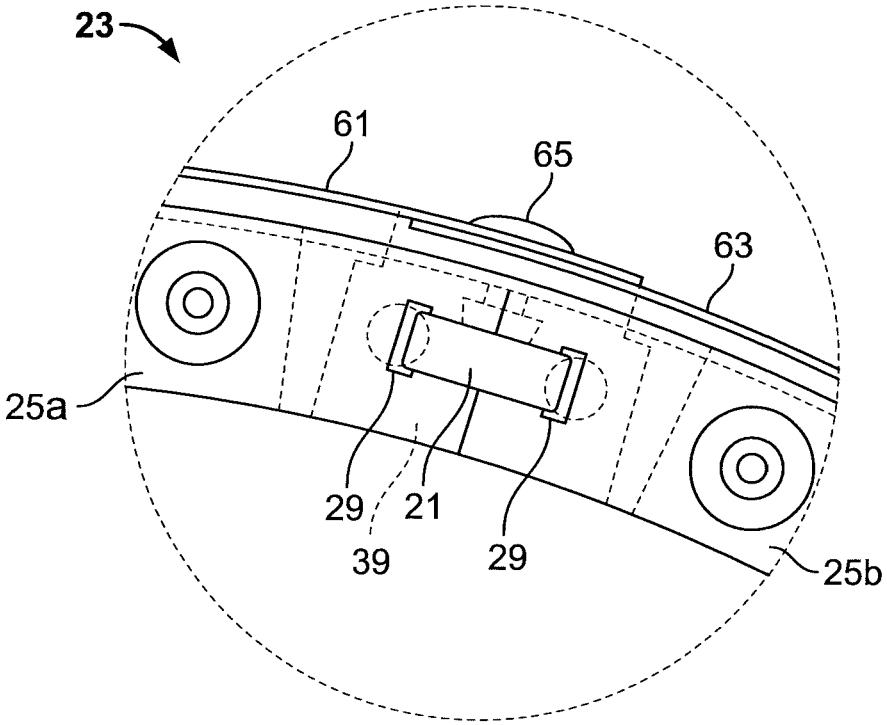
FIG. 7 is a enlarged view of circle VII of FIG. 3.

Referring now to FIG. 7, the shell 23 is formed from a rectangular sheet material, e.g., an aluminized steel, and is formed into its cylindrical shape such that the free ends 61 and 63 of the sheet overlap. The cylindrical shape is maintained by the fastener 65 extending through the connector 27 at connection A' and also extending through each end 61 and 63 of the sheet forming the shell 23 so that not only is the connector 27 linked to the shell, the shell ends are linked together to form the cylindrical shape of the heater. While one fastener is shown to link the ends 61 and 63 together, more than one could be used if so desired.

Figure 11:
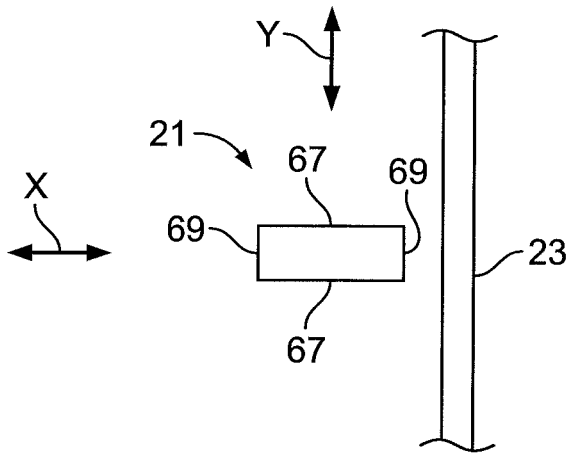
FIG. 11 is a schematic drawing showing the orientation of the resistance wire with respect to the shell of the heater of FIG. 2.

The ribbon element has a rectangular cross section as shown in FIG. 11, with opposing faces 67 and opposing edges 69. One of the edges 69 faces the inner surface 31 of the shell 23 with the faces 67 being generally perpendicular to the surface 31. With this configuration, the width dimension of the face 67 is greater than the width dimension of the edge 69. This configuration gives the ribbon element 21 more mechanical strength to prevent or deter movement of the ribbon element towards the inner surface 31 of the shell. With this configuration, the ribbon element will be more likely to move in the Y direction shown in FIG. 11 and less likely to move in the X direction. This means that there is less likelihood that the edge 69 will contact the shell 23 and cause a short circuit and disruption of the heating cycle. Consequently, insulation is not needed between the ribbon element 21 and inner surface 31 of the shell 23. While the ribbon heater element can have different dimensions, a preferred size range is about 0.02 to 0.09 inches thick (width of side edge) and about 0.1 to 0.15 inches long (width of face), with a more preferred size being ⅛ inch in width by 1/16 inch on edge. In close quarter heaters, it is typical that the heater element edge will be spaced a distance of about 2/64 inches from the heater itself. While the ribbon heater element can have different dimensions, a preferred size is one that any element dimensional values result in a ratio greater than 1.0 as calculated by dividing the width dimension of the face 67 by the width dimension of the edge 69.

The resistance heating ribbon element 21 is typically made from a Ni—Cr material that is well known in the art. However, any type of known resistance heating material can be employed. While a rectangular cross section is shown, the ribbon element can have other configurations with opposing faces and opposing edges providing that the faces are wider than the edges to provide the desired mechanical strength. For example, the ribbon element could be hexagonal in shape.

While mica is employed as a preferred material for the ribbon support segments and termination insulator, other insulating materials can be employed.

While a pair of segments is used to form each annulus of mica making up the heater, the segments could be made in 90 degree segments and the connection B would be used to connect the free ends of the segments, similar to what is accomplished in connection A'. In yet a further embodiment, the segments 25*a* and 25*b* and 25*c* and 25*d* could be made as a single segment with so that only connection A need to link the free ends of the segments at the termination point 53 together. The other connectors would merely keep the segments spaced apart for the ribbon element. In this embodiment, former segments 25*c* and 25*d* would be a one piece annulus, and segments 25*a* and 25*b* forming a near annulus but for space for termination.

The termination configuration is exemplary and other configurations of insulation and terminal could be employed. For example, the terminal could be positioned above the mica board 51 so that openings therein are not needed. The connectors 27 could just have openings in the body thereof for attachment to the shell and not have openings for weight reduction.

The heater of the invention can be used in virtually any environment, wherein the space surrounded by the ribbon element must be heated using resistance heating. The circular configuration of the segments and shell is exemplary only and other shapes could be employed, providing that the shapes can maintain a relatively uniform weave of the ribbon element along the periphery of the shell.

As such, an invention has been disclosed in terms of preferred embodiments thereof which fulfills each and every one of the objects of the present invention as set forth above and provides a new and improved close quarter electric resistance heater and its method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An electric resistance heater comprising:

a shell having a first open end and a second open end;

a heater element assembly comprising:

at least a first insulating support segment, and at least a second insulating support segment, a plurality of connectors, said first and second insulating support segments mounted together and in a spaced apart relationship using the plurality of connectors, each connector further comprising one end that is attached to one of the first or second insulating support segments, an opposite end that is attached to the other of the first and second insulating support segments, and a connector body extending between the one and opposite ends, the connector body also mounted to the shell, a resistance ribbon heater element, having opposing edges and opposing faces, mounted between the first and second insulating support segments in a generally sinusoidal pattern, the width of the opposing faces being greater than a width of the opposing edges, a termination assembly comprising an insulator mounted to one of the connectors where ends of the ribbon heater element terminate in the shell and a pair of terminals respectively connected to ends of the ribbon heater element, wherein the first and second insulating support segments supporting the ribbon heater element are mounted to the shell such that one of the opposing edges of the ribbon heater is facing an inside surface of said shell to minimize movement of the ribbon heater element towards a surface of the shell and short circuiting.

2. The heater of claim 1, wherein said shell is tubular.

3. The heater of claim 1, wherein the insulating support segments are mica board.

4. The heater of claim 1, further comprising a pair of said first insulating support segments and a pair of said second insulating support segments.

5. The heater of claim 4, wherein each of the insulating support segments is a mica board.

6. The heater of claim 1, wherein the insulating support segments include spaced apart slots to receive the ribbon heater element.

7. The heater of claim 1, wherein each of said connectors is y-shaped with a first leg including the one end and opposing pair of second legs, each second leg including the opposite end, each of the one end and opposite ends having flanges for mounting to said first and second insulating support segments.

8. The heater of claim 7, wherein each of said connector bodies has at least one opening for mounting to the shell.

9. The heater of claim 1, wherein the ribbon heater element has a rectangular cross section.

10. The heater of claim 7, wherein the adjacent Y-shaped connectors have an opposite orientation so that the ribbon heater element can maintain its generally sinusoidal pattern when extending along the insulating support segments.

* * * * *